US010052738B2

(12) United States Patent
Twelves, Jr. et al.

(10) Patent No.: US 10,052,738 B2
(45) Date of Patent: Aug. 21, 2018

(54) INTERNAL SURFACE FINISHING APPARATUS AND METHOD

(71) Applicant: United Technologies Corporation, Hartford, CT (US)

(72) Inventors: Wendell V. Twelves, Jr., Glastonbury, CT (US); John P. Rizzo, Jr., Vernon, CT (US); Evan Butcher, Manchester, CT (US); Lexia Kironn, Rocky Hill, CT (US); Joseph Ott, Enfield, CT (US)

(73) Assignee: United Technologies Corporation, Farmington, CT (US)

( * ) Notice: Subject to any disclaimer, the term of this patent is extended or adjusted under 35 U.S.C. 154(b) by 218 days.

(21) Appl. No.: 14/715,009

(22) Filed: May 18, 2015

(65) Prior Publication Data

US 2016/0339558 A1 Nov. 24, 2016

(51) Int. Cl.

*B24B 31/00* (2006.01)
*B24B 31/10* (2006.01)
*B24B 31/02* (2006.01)

(52) U.S. Cl.

CPC ..... *B24B 31/006* (2013.01); *B24B 31/0218* (2013.01); *B24B 31/10* (2013.01)

(58) Field of Classification Search

CPC ... B24B 31/006; B24B 31/0218; B24B 31/10; B01F 9/0001; B01F 11/0062; B01F 11/0025; Y10T 74/2109; G01M 1/36; B04B 5/042; B04B 5/02

USPC ..... 451/32, 329; 366/217

See application file for complete search history.

(56) References Cited

U.S. PATENT DOCUMENTS 1,776,143 A 9/1930 Brown
1,913,919 A 6/1933 Farrington
2,265,043 A * 12/1941 Moore ..... B22D 13/00 164/287
2,487,937 A * 11/1949 Miskunas ..... A61C 13/20 164/290
2,797,902 A * 7/1957 Beugler ..... B01F 11/0025 248/241
3,094,818 A 6/1963 Price
3,503,157 A 3/1970 Harper
3,579,920 A * 5/1971 Heiberger ..... B24B 31/023 241/177
3,609,921 A * 10/1971 Foster ..... B24B 31/10 241/176
3,679,184 A * 7/1972 Woodham ..... B01F 9/0034 206/219

(Continued)

OTHER PUBLICATIONS

Lee5490. "Bolt Tumbler." YouTube. YouTube, Apr. 27, 2008. Web. Aug. 7, 2017.*

(Continued)

*Primary Examiner* — Joseph J Hail
*Assistant Examiner* — Arman Milanian
(74) *Attorney, Agent, or Firm* — Kinney & Lange, P.A.

(57) ABSTRACT

An embodiment of an apparatus includes a centrifugal drive unit, an arm assembly, an optional dynamic balancing ring, and a workpiece fixture. The arm assembly is operatively connected to the centrifugal drive unit and configured to revolve about a primary axis perpendicular to the arm. The workpiece fixture is mounted to the arm assembly, and is configured to rotate at least one workpiece about at least one secondary axis outboard of the primary axis.

42 Claims, 11 Drawing Sheets

(56) References Cited

U.S. PATENT DOCUMENTS 4,586,292 A * 5/1986 Carroll ..... B24B 11/00 366/219
4,807,403 A * 2/1989 Kobayashi ..... B24B 31/033 451/32
4,978,548 A * 12/1990 Cope ..... A23L 7/13 426/439
5,167,448 A * 12/1992 Herold ..... B01F 15/0205 366/213
5,355,638 A 10/1994 Hoffman
5,505,978 A * 4/1996 Roy ..... A23L 7/117 426/439
5,592,870 A * 1/1997 Sanchez ..... A21C 5/00 99/353
6,355,289 B1 * 3/2002 Rolow ..... A21D 2/02 426/321
6,491,959 B1 * 12/2002 Chiang ..... A21D 13/0074 426/549
6,830,767 B2 * 12/2004 Teras ..... A21B 5/08 426/439
7,077,560 B2 * 7/2006 Huckby ..... B01F 9/0001 220/628
7,507,015 B2 * 3/2009 Wang ..... B01F 9/0001 366/217
8,092,075 B2 * 1/2012 Ishii ..... B01D 19/0052 366/139
8,513,571 B2 * 8/2013 Gonzalez ..... A21B 3/07 219/388
2002/0044996 A1 * 4/2002 McNeel ..... A21C 11/04 426/549
2002/0132029 A1 * 9/2002 Teras ..... A23L 7/117 426/283
2003/0068398 A1 * 4/2003 Chandler ..... A21C 9/085 425/208
2004/0091596 A1 * 5/2004 Schellhaass ..... A21D 13/0074 426/549
2005/0142273 A1 * 6/2005 Schellhaass ..... A21D 13/0074 426/549
2006/0177552 A1 * 8/2006 Baylor ..... A21B 5/08 426/496
2007/0254077 A1 * 11/2007 Germano ..... A23P 30/20 426/516
2008/0095884 A1 * 4/2008 Ross ..... A21D 8/042 426/18
2008/0138480 A1 * 6/2008 Bows ..... A23P 30/32 426/465

OTHER PUBLICATIONS

Extended European Search Report, for European Patent Application No. 16170134.7, dated Sep. 23, 2016, 8 pages.

* cited by examiner

INTERNAL SURFACE FINISHING APPARATUS AND METHOD

BACKGROUND

The disclosure relates generally to processing of workpieces and more specifically to apparatus and methods for finishing internal surfaces of said workpieces.

Workpieces with internal cavities can require internal surface processing (roughening, smoothing, or introduction of compressive stresses) but current apparatus and methods do not form reliable and uniform application throughout the interior. Readily accessible surfaces (e.g., within the line of sight) may be addressed with machining, grinding, or a wide variety of abrasive media processes to improve the surface finish. Currently, these processes are most successful when applied to external surfaces and relatively short, straight internal passages with constant cross sections.

Non-line-of-sight internal passages with serpentine paths and irregularly shaped cavities are difficult or even impossible to effectively polish. Turbine engine components are one example of workpieces which contain such passages, and are subject to high cycle fatigue (HCF) and low cycle fatigue (LCF) service environments. The physics involved in additive manufacturing deposition processes for metal, polymer, and ceramic components results in a relatively rough, Ra 150 to Ra 1000 micro inches, as-built surface finish. An improved surface finish in the range of Ra 1 to Ra 125 micro inches can be required to avoid premature cracking and part failure.

SUMMARY

An embodiment of an apparatus includes a centrifugal drive unit, an arm assembly operatively connected to the centrifugal drive unit and configured to revolve about a primary axis perpendicular to the arm, and a workpiece fixture. The workpiece fixture is mounted to the arm assembly, and is configured to rotate at least one workpiece about at least one axis outboard of the primary axis.

An embodiment of a method for processing a workpiece having at least one internal passage includes providing processing media within the internal passage of the workpiece. The workpiece is revolved around an external axis so as to accelerate the processing media against one or more targeted internal surfaces defining the internal passage. The workpiece is oriented to manipulate the processing media relative to the one or more targeted surfaces. The revolving step and the orienting step are controlled to uniformly process the one or more targeted surfaces.

DETAILED DESCRIPTION

This disclosure generally teaches that an enhanced acceleration field can increase the velocity, kinetic energy, and resultant abrasive action of media against external and internal workpiece surfaces. An apparatus and method utilize various particulates or other media disposed in an internal workpiece passage (or passages). The workpiece and particulates can be manipulated in a multiaxis format to provide enhanced gravity to the particles for both space-bound and earthbound processes. An accompanying fixture can be capable of reorienting the workpiece(s) on an intermittent, cyclical, or a continuous basis in a media flow field. Depending on the location, an enhanced gravity field can register from about 0.01 G up to about 10,000 G. A more typical range of acceleration values for earth bound industrial processes may be 1.01 G to 200 G. The enhanced acceleration field can be realized with rotary motion, linear motion, or a combination of both.

Figure 1:
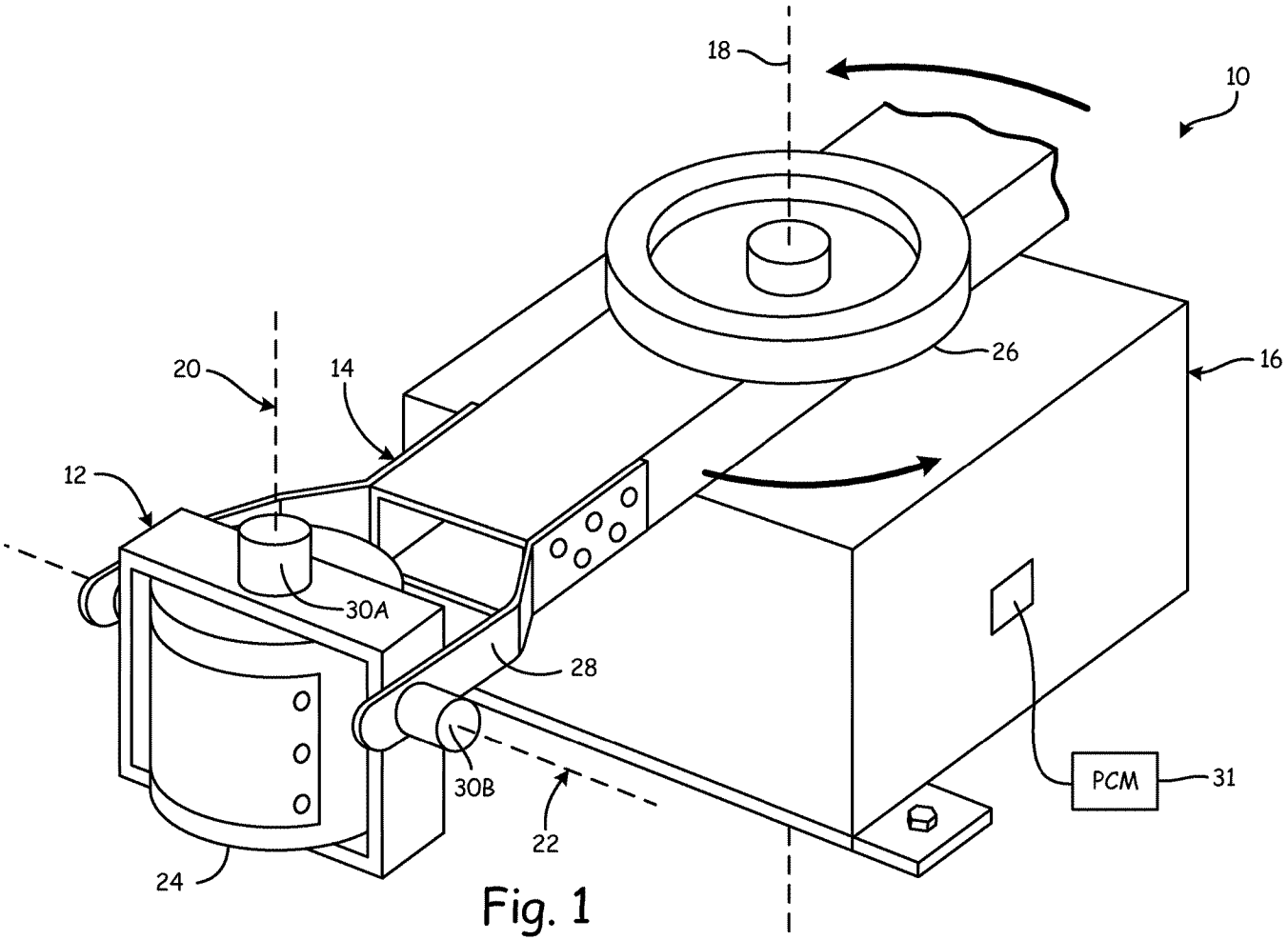
FIG. 1 is a schematic view of a processing apparatus for a first workpiece fixture.

A centrifuge is the subject of an embodiment shown in FIG. 1. FIG. 1 shows assembly 10, and generally includes workpiece holding fixture 12 secured to a distal end of arm or beam 14 operatively connected to centrifugal drive unit 16. Arm 14 can be configured to revolve about primary axis 18 passing therethrough. Here, arm 14 has a fixed length and thus results in a substantially circular path for fixture 12 to revolve about primary axis 18. Centrifugal drive unit 16 can include at least one motor (not visible) for driving arm 14.

Workpiece holding fixture 12 can be configured to rotate at least one workpiece (better seen in subsequent figures) about one or more axes. In the example shown, gimbaled fixture 12 is secured to arm 14 via one or more attachments for rotation about one or more outboard axes (secondary axes 20, 22). Fixture 12 and secondary axes 20, 22 are thus configured to maintain the workpiece at an outboard location along arm 14. FIG. 1 shows a receptacle for receiving and retaining a workpiece. Here, that receptacle includes workpiece housing 24 to secure the workpiece and processing media (shown in FIGS. 2A-3B). Revolving fixture 12 via arm 14 accelerates the workpiece and media contained therein, and results in an enhanced gravity field applied to the workpiece and the media. Though shown with a single fixture 12 and arm 14, it will be appreciated that assembly 10 can be readily modified to include multiple fixtures 12 and/or multiple arms 14 rotatable about primary axis 18.

Dynamic balancing ring 26 can be disposed at a junction of centrifugal drive unit 16 and arm 14, and is provided to compensate for the changing positions of fixture 12, as well as the workpiece and media (not shown in FIG. 1) during operation of assembly 10.

A workpiece can be reoriented with a single or a multi-axis rotating fixture on either a continuous, semi-continuous, or periodic basis to present one or more targeted surfaces to moving media. Workpiece reorientation in the enhanced gravity field (provided by a centrifuge or substantially equivalent device) may be accomplished with constant velocity or intermittent rotary motion around a single axis, around multiple axes, or combinations thereof.

Here, fixture 12 is secured to arm 14 via clevis 28. One or both gimbaled attachments may be motorized (via fixture motors 30A, 30B) to drive selected orientations about one or both secondary axes 20, 22. Power for fixture motors 30A, 30B can be electrical, pneumatic, hydraulic, or a gear or belt driven mechanism. If electric, power can be supplied through a slip ring, an induction system, batteries, or other suitable means.

Note that the fixture can be driven by a centrifuge or other relatively simple, economical machine consisting of a frame, a shaft, bearings, a drive motor, and an optional dynamic balancing wheel. The frame may be designed to accommodate an overhung rotor or a center hung rotor. The basic design of the centrifuge may be readily scaled to accommodate large or small workpiece families.

A programmable control module (PCM) 31 can be connected to provide drive commands to assembly 10, controlling manipulation of the workpiece and orientation and rotational velocity of the workpiece around each axis (e.g., axes 18, 20, 22 in FIG. 1) during one or more processing operations. Movement about each axis can be mutually dependent or can be individually and independently controlled. Coordination between two or more axes can target selected workpiece surfaces and optimize the desired finishing process for a specific workpiece geometry. The rotating workpiece holding fixture(s) (e.g., fixture 12/housing 24) can also incorporate a reciprocating or oscillating vibration mechanism (not visible in FIG. 1) to further enhance the abrasive action of the media particles in the enhanced acceleration field.

Figure 2A:
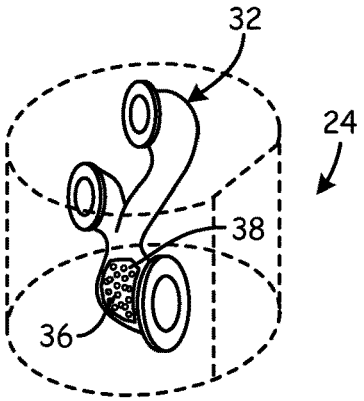
FIG. 2A shows processing media in the workpiece mounted to the first example embodiment of the workpiece fixture housing.
Figure 2B:
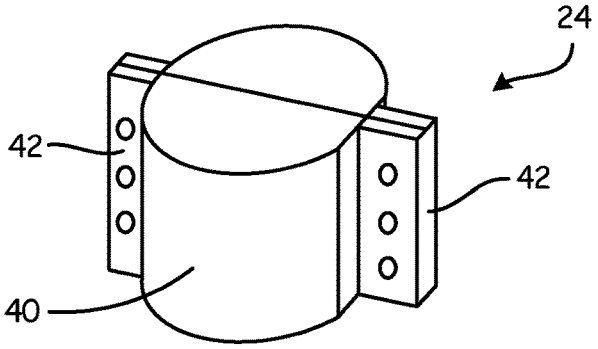
FIG. 2B depicts a workpiece fixture housing embodiment in an open position.
Figure 2C:
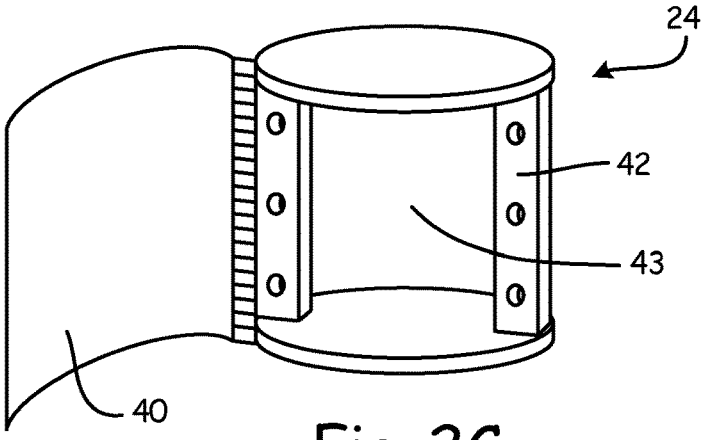
FIG. 2C depicts the workpiece fixture housing embodiment in a closed position.

FIGS. 2A-2C illustrate one example configuration for fixturing and manipulating a workpiece. FIG. 2A shows a partial view of workpiece 32. Workpiece housing 24 is shown in phantom to depict workpiece 32 retained in housing 24, which in turn is cut away to show media 36 in internal cavities 38. The example workpiece 32 has several irregular, non line-of-sight passages which make it difficult to access the internal surfaces defining them using conventional techniques. Manipulation and orienting of workpiece 32 via housing 24 (and in general via apparatus 10) as described with respect to FIG. 1 results in media traveling through these cavities 38, contacting the defining internal surfaces to polish or otherwise process them.

Generally, processing media can include, among other things, a transport agent and/or an abrasive agent. The transport agent can include a solid, a fluid, or a fluidized agent. Examples of suitable transport fluids include pressurized gas (air or inert gas), water, and mineral oil. The solid can be a metal, ceramic, or polymer.

In one example, internal workpiece surfaces may be polished by locating abrasive media within the cavities and passages of the workpiece. As the workpiece is reoriented within the enhanced acceleration field the sliding action of the media will polish the surfaces it contacts. However, the apparatus and method are not limited to polishing. In one non-limiting additional or alternative step, metal shot can take the place of polishing media for peening one or more interior surfaces, introducing residual compressive stresses.

Candidate abrasive media materials for this process include any of the common industrial abrasives. Typical media types can include alumina (aluminum oxide), silicon carbide, silica (sand, glass beads, or the like), diamond, garnet, metal (e.g., steel shot), organic material (e.g., walnut shell). The size and shape of individual media particles will be determined by the application. The media may be wet or dry.

Figure 7:
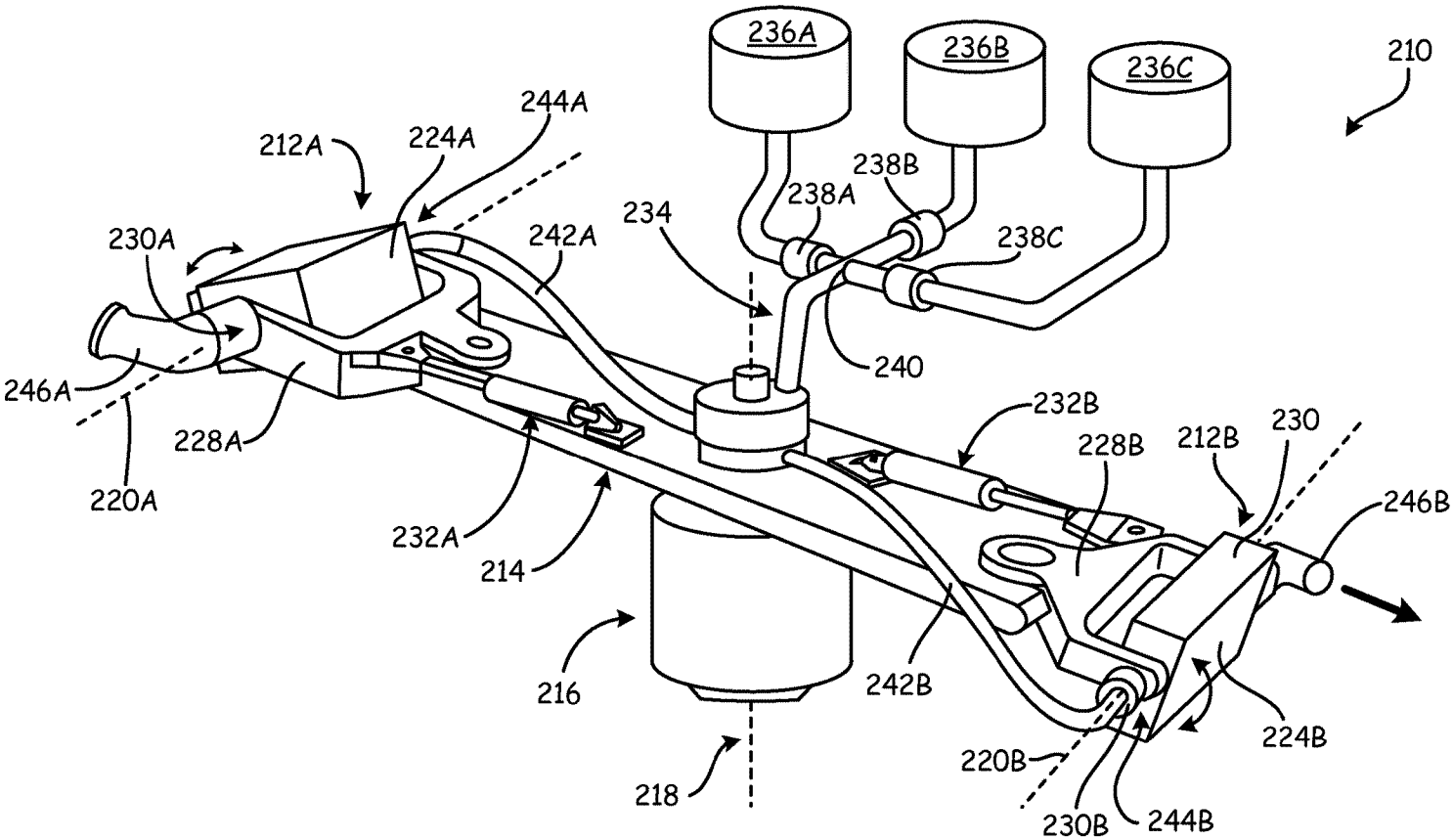
FIG. 7 is an alternative embodiment, showing a media change system incorporated into an arm assembly.

Work piece holding fixtures may have features such as internal chambers and valves or external supply lines to control the movement, evacuation, and replacement of abrasive media during the surface finishing process. One example of such a system is shown in FIG. 7.

FIG. 2B shows workpiece housing 24 with door 40 closed, showing mounting brackets 42. In FIG. 2B, door 40 is closed so that workpiece 32 (shown in FIG. 2A) is contained therein. Mounting brackets 42 can be provided on the outside of housing 24 for securing to arm 14 (e.g., via clevis 28 shown in FIG. 1). With respect to FIG. 2C, workpiece housing 24 has door 40 open, showing interior 43 for receiving and retaining workpiece 32 (shown in FIG. 2A). Brackets 42 can be incorporated into housing 24 in or around door 40 in such a way as to allow access to interior 43 with workpiece housing 24 remaining attached to arm 18 (shown in FIG. 1). Internal mounting devices (omitted for clarity) can be contained in workpiece housing 24 to secure workpiece 32. Alternatively, housing 24 can be sized so that it will securely encompass workpiece 32, keeping it in place during operation and manipulation.

Figure 3A:
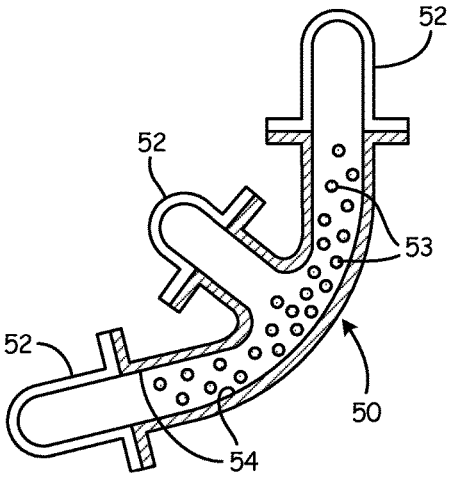
FIG. 3A is a sectional view of a first example workpiece adapted to contain processing media.
Figure 3B:
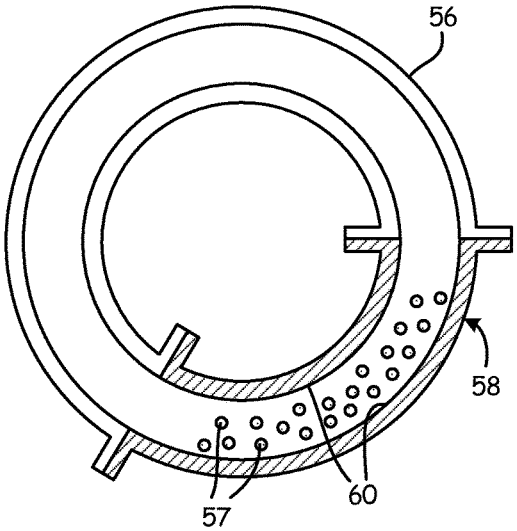
FIG. 3B shows a sectional view of a second example workpiece adapted to contain processing media.

FIGS. 3A and 3B show a manifold workpiece with two approaches for enclosing processing media. FIG. 3A shows one example of manifold workpiece 50 with end caps 52. Media 53 is manipulated against internal workpiece surfaces 54 via enhanced gravity and orientation about one or more axes as shown in other figures. FIG. 3B shows a second example with passage extension 56 attached to manifold workpiece 58, and can be handled in a similar manner so as to process internal workpiece surfaces 60 with media 57.

It will be apparent that manipulation of workpieces with open ends and irregular shapes can have some sort of enclosure to prevent loss of media in use. Note that the path length and route the media travels may be tailored with polymer or metal orifice cap extensions which may dead end or loop around to another orifice to create a continuous circuit. Custom tooling of this nature provides additional options for managing media flow and abrasive action. The first example may work best with an oscillating motion of fixture 12 (shown in FIG. 1), while the second example may work best with rotational motion.

Figure 4A:
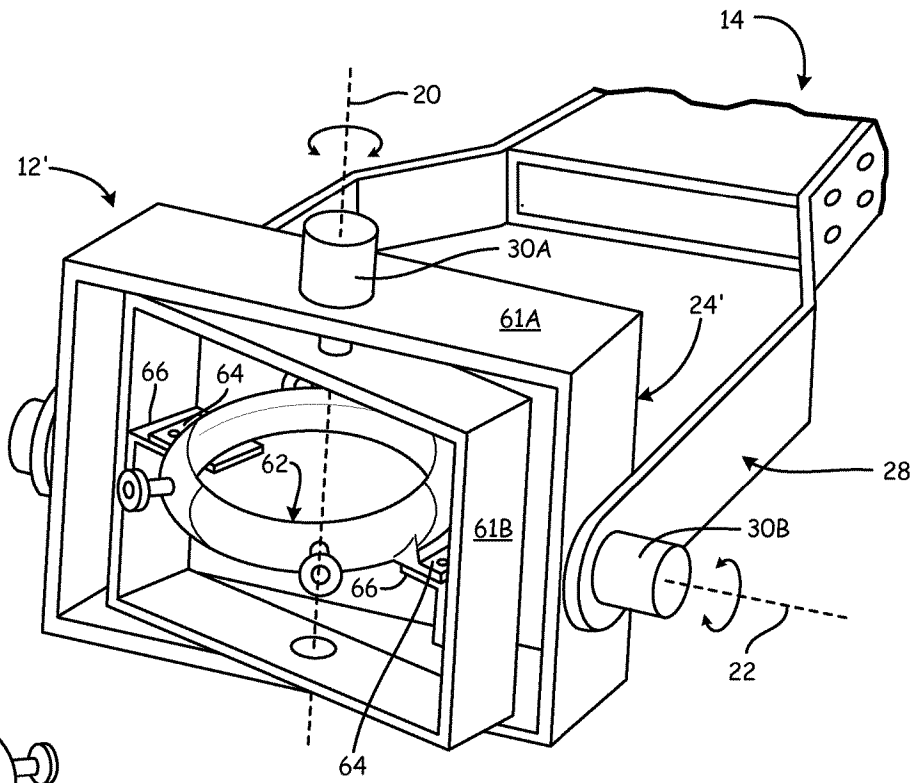
FIG. 4A is a schematic view of a workpiece processing apparatus with a second workpiece fixture.
Figure 4B:
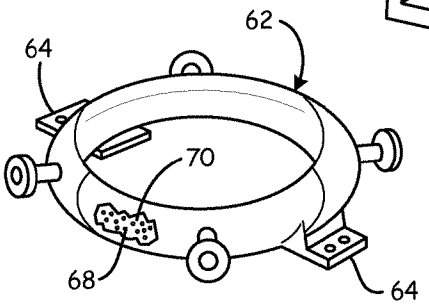
FIG. 4B is a schematic view of the workpiece shown in FIG. 4A.

FIG. 4A shows an additional embodiment of fixture 12', mounted to arm 14 via clevis 28. Here, fixture 12' includes an open gimbaled fixture enclosure 24' with first receptacle portion 61A rotatable about secondary axis 20 and second receptacle portion 61B rotatable about secondary axis 22. For specific part families such as manifold workpiece 62 shown in FIG. 4B, mounting in a fixture may be simplified with external, removable mounting tabs 64 and optional structural reinforcement. As such, manifold workpiece 62 can be mounted and secured directly to surfaces 66 of gimbaled fixture enclosure 24'. Rotation about secondary axes 20, 22 can be facilitated by motors 30A, 30B similar to that which is shown and described with respect to FIG. 1. Media 68 is passed through internal passages 70 in manifold workpiece 62 in a similar manner as to other examples.

In one example, a workpiece is formed at least in part by one or more additive manufacturing processes. In such a situation, the mounting tabs or other surfaces can be co-grown with the workpiece much like end caps and/or passage extensions in other examples.

Figure 5A:
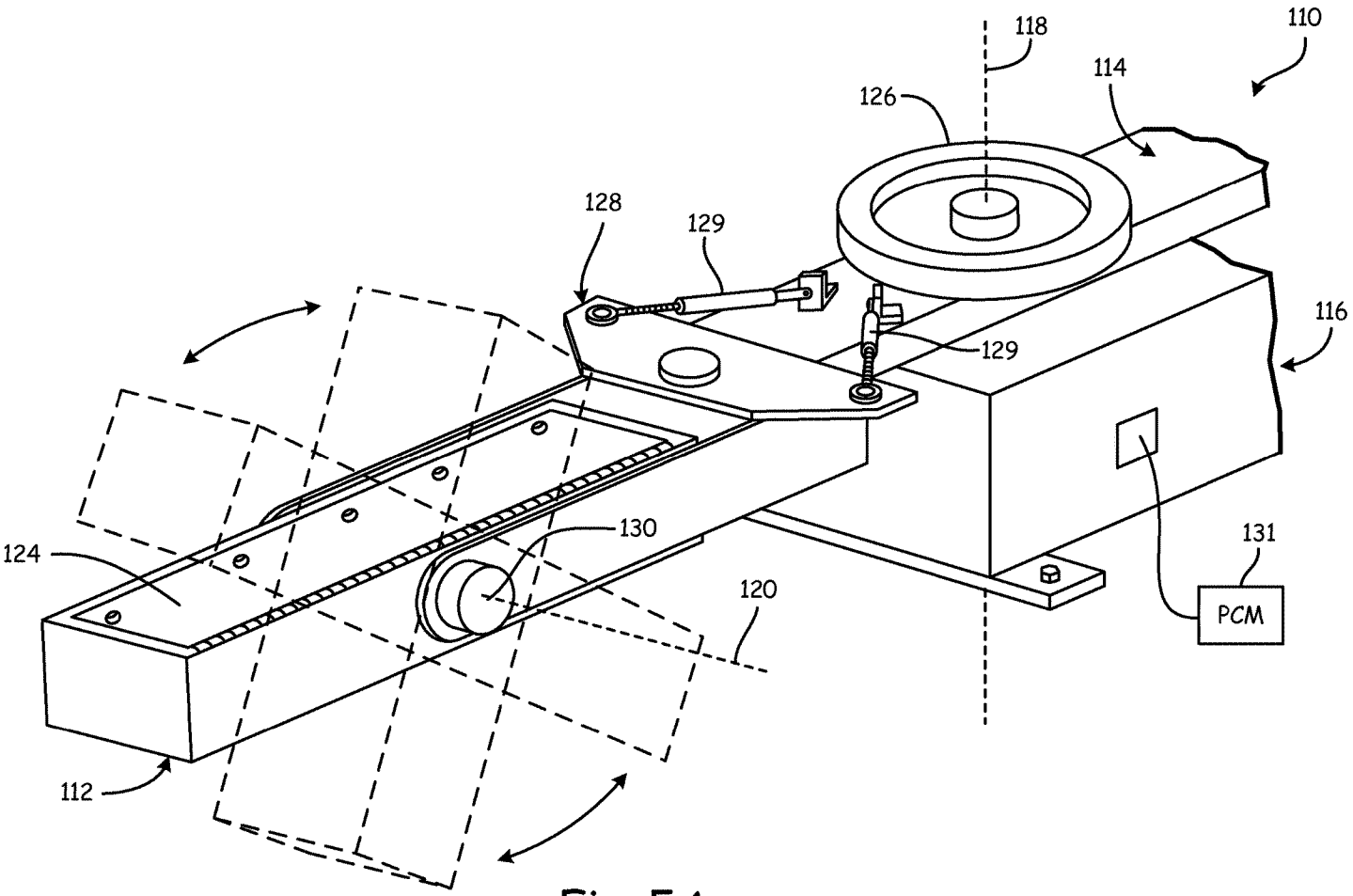
FIG. 5A is a schematic of a processing apparatus with a third workpiece fixture in a position for in-plane rotation.
Figure 5B:
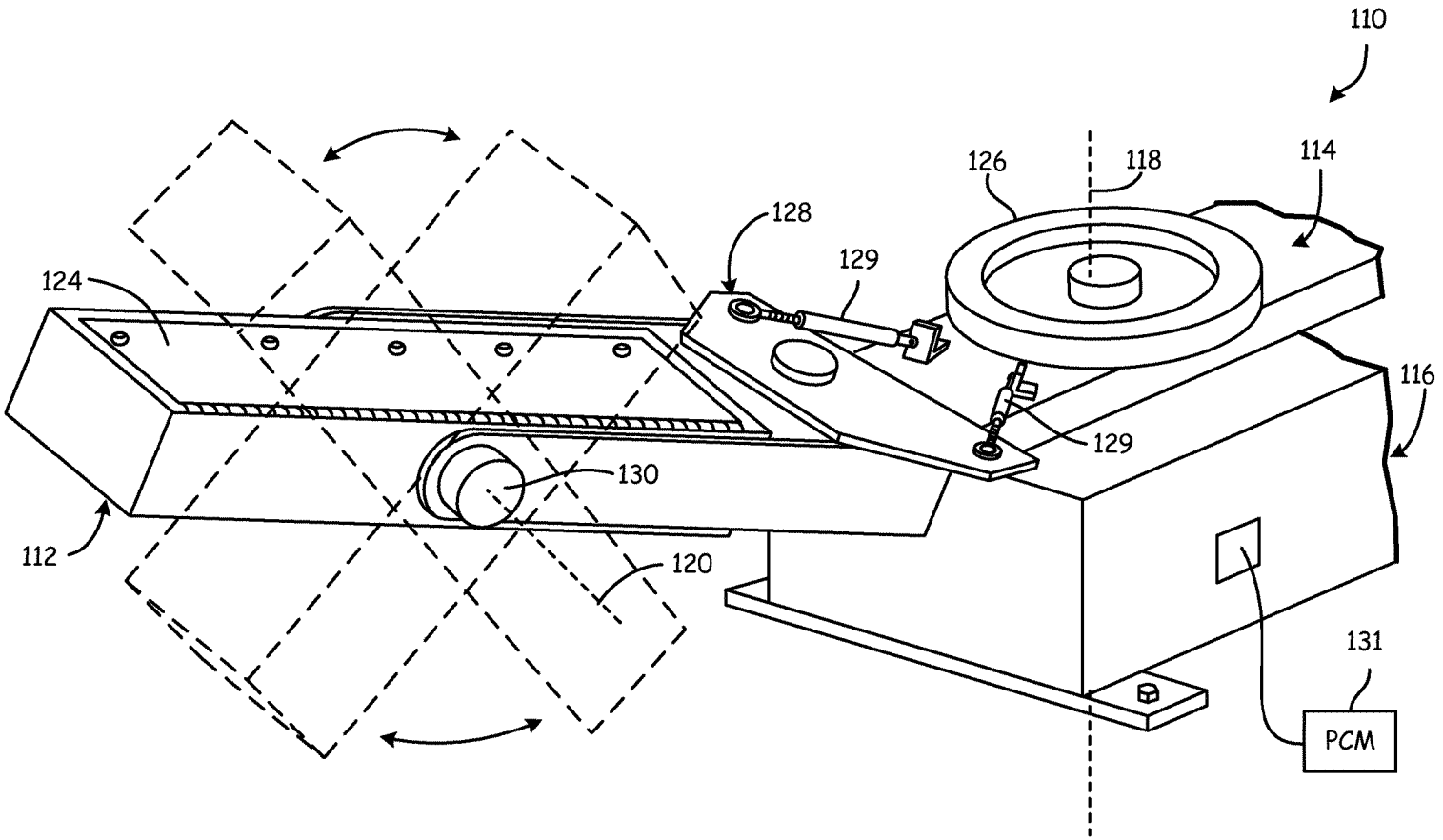
FIG. 5B is a schematic of the processing apparatus and third workpiece fixture in a position for out-of-plane rotation.

FIGS. 5A and 5B illustrate a second embodiment of a processing apparatus in two different operating modes. Apparatus 110 includes tumbling workpiece fixture 112 mounted to arm assembly 114, outboard of centrifuge unit 116. Similar to the arrangement shown in FIG. 1, centrifuge unit 116 can include a motor (not visible) for powering rotation of arm assembly 112 about primary axis 118 to provide an enhanced gravity field (e.g., from 0.01 G to about 10,000 G in extremis, and more typically from 1.01 G to about 200 G in earthbound applications).

Fixture 112 can include one or more attachments for mounting a workpiece (not visible in FIGS. 5A and 5B) internally near or about secondary axis 120. Here, housing 124 receives and retains a workpiece for rotation about secondary axis 120 outboard of primary axis 118. Apparatus 110 can also include dynamic balance ring 126 to facilitate enhanced gravity during simultaneous rotation about axes 118 and 120.

Both external and internal work piece surfaces may be processed in this type of fixture. As fixture 112 rotates end over end (about secondary axis 120), loose media migrates under the influence of the enhanced acceleration field from one end of the fixture to the other, striking the workpiece located near the center (shown in FIG. 6A-6B). Rotation can be actuated by a motor or other device 130. It will also be noted that tumbling fixture 112, or other example fixtures can be adapted to include a plurality of circumferentially spaced receptacles for retaining one or more corresponding workpieces (e.g., workpieces 32, 132). The adapted fixture tumbles similar to fixture 112 about axis 120, and operation is reminiscent of a ferris wheel about one or more secondary axes.

In the embodiment of arm assembly 114 shown in FIGS. 5A and 5B, apparatus 110 can additionally or alternatively be configured to provide out-of-plane rotation of fixture housing 124, and the retained workpiece(s) during some or all of the surface processing time. FIG. 5A shows arm assembly 114 in a configuration for in-plane rotation of fixture 112, while FIG. 5B shows rotation of fixture 112 in a nonplanar orientation. This can be achieved, for example by operating actuator(s) 129 to lift and lower arm extension 128 (i.e., control its yaw angle). With a constant yaw angle, arm assembly 114 rotates in a plane substantially normal to primary axis 118. And when the yaw angle is zero, distance of fixture 112 from primary axis 118 is maximized, and linear velocity of fixture 112 is minimized (for a given rotational velocity). Linear velocity of fixture 112 can be increased by changing the yaw angle of arm assembly 114 (e.g., via actuators 129) without changing the rotational velocity of centrifuge unit 116. In addition to control of motion about axes 118 and 120, process control module 131 can be programmed or otherwise directed to operate actuator (s) 129 in a manner to optimize the desired surface processing. Actuators 129 or the equivalent can provide flexibility to arm assembly 114 with at least one additional option to expedite processing of hard-to-reach internal surfaces.

Figure 6B:
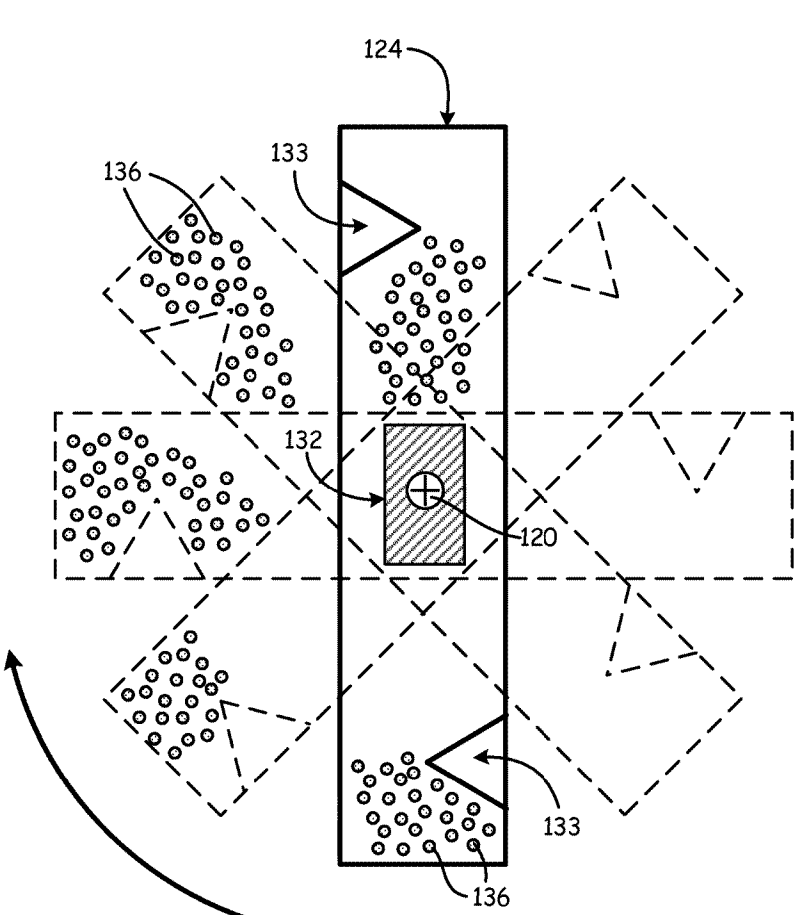
FIG. 6B shows details of manipulating a workpiece in the third workpiece fixture.
Figure 6A:
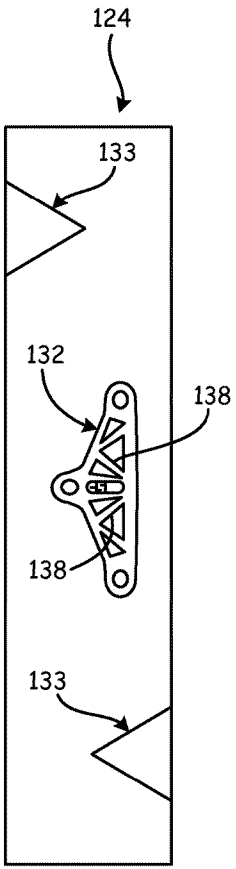
FIG. 6A shows details of the second workpiece fixture.

FIG. 6A illustrates a conceptual cross section of the elongated hollow tumbling fixture housing 124 and FIG. 6B shows media migration in housing 124 when controlled by a passive wedge valve 133. FIG. 6A shows passive valve 133 to control timing of when media 136 is released toward workpiece 132 (with internal surfaces 138). In conjunction, the rotational velocity profile of the hollow fixture housing 124 may also be tailored to optimize the release of the abrasive media (over time, all at once, or in pulses). Workpiece 132 can be fixed or movable to allow selected surfaces to be presented to moving media 136 in a most favorable orientation determined by its shape and the desired outcome. Additionally, guide conduits can optionally be employed within the hollow fixture to direct the media to specified surfaces. Both external and internal surfaces can be processed simultaneously. Other valve types may be used such as an active valve (see, e.g., FIG. 7).

FIG. 7 shows an embodiment of apparatus 210 and is described with a dual-sided arm assembly 214 and a pair of fixtures 212A, 212B. However, with appropriate balancing configurations, a single fixture or more than two fixtures can be incorporated.

Fixtures 212A, 212B are operatively connected outboard of centrifuge drive unit 216. Basic operation is similar to other example embodiments, in which centrifuge drive unit rotates arm assembly 214 about central or primary axis 218 to provide an enhanced gravity field. Outboard fixtures 212A, 212B are also rotatable about at least one secondary axis 220A, 220B outboard of primary axis 218. Fixtures 212A, 212B can be secured via devises 228A, 228B and driven via motors 230A, 230B or equivalent (See FIG. 1 for example). Like other embodiments, a workpiece (not shown in FIG. 7) can be enclosed within or otherwise secured to workpiece fixture housings 224A, 224B which each include one or more receptacles (not visible) for receiving and retaining corresponding workpiece(s). In addition, optional actuators 232A, 232B change the yaw angle of arm assembly 214, which in turn change the rotational path of fixtures 212A, 212B and the attached workpiece in the previously described manner. The centrifuge housing, dynamic balance ring, and control module shown in other example embodiments are omitted for clarity but suitable embodiments of these and other elements can be assumed to be present unless otherwise stated.

FIGS. 6A and 6B showed a passive valve configuration which provide for an economical approach to controlled or delayed introduction of processing media. In FIG. 7, an active media change system is incorporated into apparatus 210 to more completely control inlet and outlet of various media into the fixture. This can enable multi-step processing of internal surface(s) without having to reposition the workpiece into another apparatus or housing.

Thus in addition to the above basic and optional elements, media change assembly 234 can also be incorporated into this or other embodiments. Here, various processing media can be stored in a plurality of hoppers (e.g., hoppers 236A, 236B, 236C), flow of each media controlled by a corresponding valve or plurality of valves (e.g., valves 238A, 238B, 238C). Media is fed to union 240 which can be disposed along or proximate to primary axis 218.

Media is transported from one or more of the hoppers to fixtures 212A, 212B (and the corresponding workpieces) by transport conduits 242A, 242B. Conduits 242A, 242B can generally be flexible metallic or nonmetallic tubing depending on a particular application. In certain limited embodiments, nonflexible tubing can be used where there would be minimal bending or twisting stresses such as where the yaw angle is fixed.

Since fixtures 212A, 212B are also rotatable about one or more different axes (here, respective secondary axes 220A, 220B), a pair of unions 244A, 244B can be provided at the outboard locations adjacent to workpiece fixture housings 224A, 224B. Unions 240, 244A, and/or 244B can include centrifugal vanes (not shown) or other suitable means for directing media to the respective workpieces.

For each type of media, it can be evacuated from fixtures 212A, 212B through outlets 246A, 246B. These can include an opposing discharge or dump valve, or additional unions adjacent to secondary axes 220A, 220B. Selection of a particular type of outlet will depend on whether the media will be continuously refreshed during processing, or whether each step is performed on a batch basis. Once the media is evacuated from fixtures 212A, 212B, additional conduits (not shown) can direct used media away from apparatus 210 and the media can be reused, recycled, regenerated, or otherwise suitably disposed of.

Figure 8A:
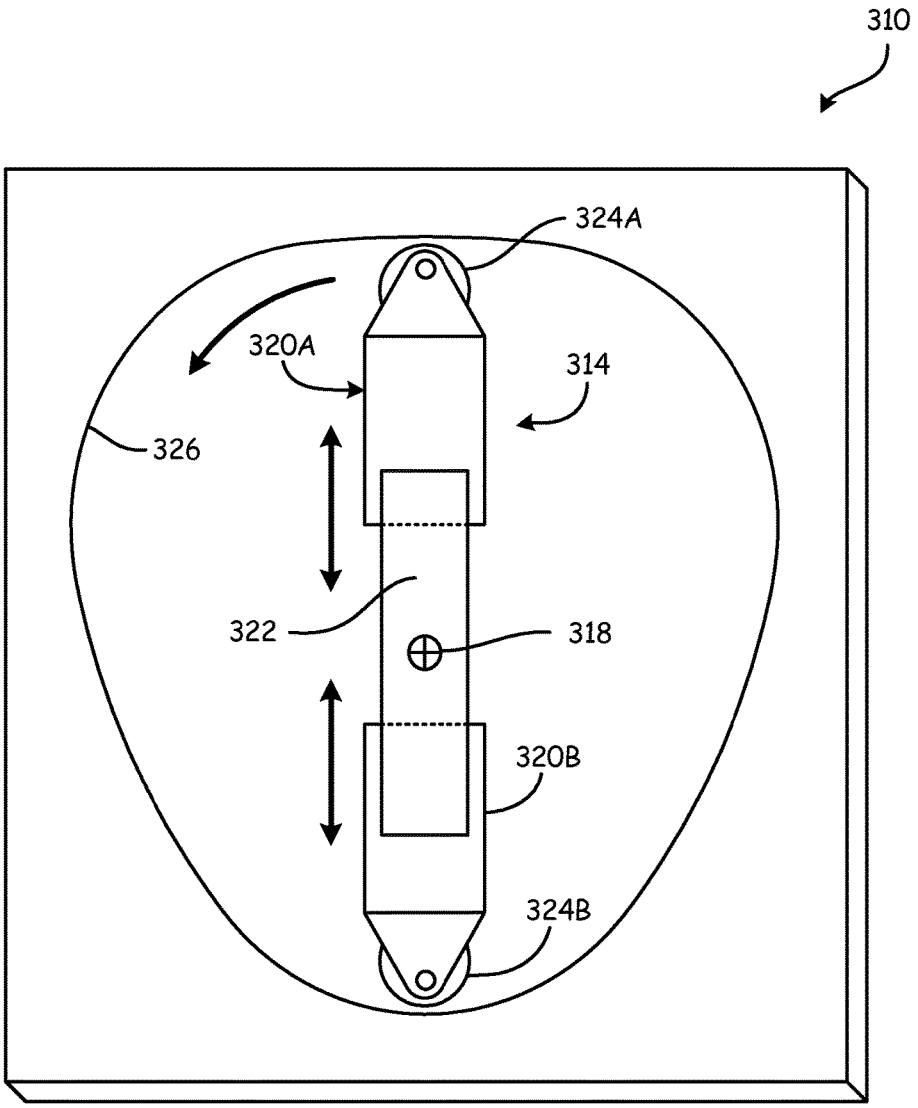
FIG. 8A shows a schematic example of an arm assembly configured to provide a noncircular path for a workpiece fixture.

FIG. 8A is a partial sectional view of a portion of yet another example embodiment, apparatus 310. This facilitates a noncircular rotational path for one or more fixtures attached to arm assembly 314, and in turn, facilitates continuous variation of the enhanced gravity field. In the example embodiment, a number of elements are omitted for clarity but it will be appreciated that arm assembly 314 can be incorporated in place of other arm assemblies from other example embodiments.

Arm assembly 314 includes telescoping sleeve portions 320A, 320B disposed outboard of primary axis 318, and which are configured to extend and retract radially relative to central arm portion 322. As the unit is driven circumferentially by the centrifuge unit (not shown in FIG. 8) about axis 318, cam followers 324A, 324B follow the inside of noncircular track 326. This allows the length of arm assembly 314 to be adjustable during operation so that one or more workpiece fixtures will be subjected to variation in the enhanced gravity field based on the constant rotational velocity and continuously changing radial distance of the workpieces (not shown) from primary axis 318. In an alternative embodiment, cam followers 324A, 324B and track 326 can be replaced or supplemented by linear actuators (shown in previous figures) to allow for second order changes in the enhanced gravity field.

Figure 8C:
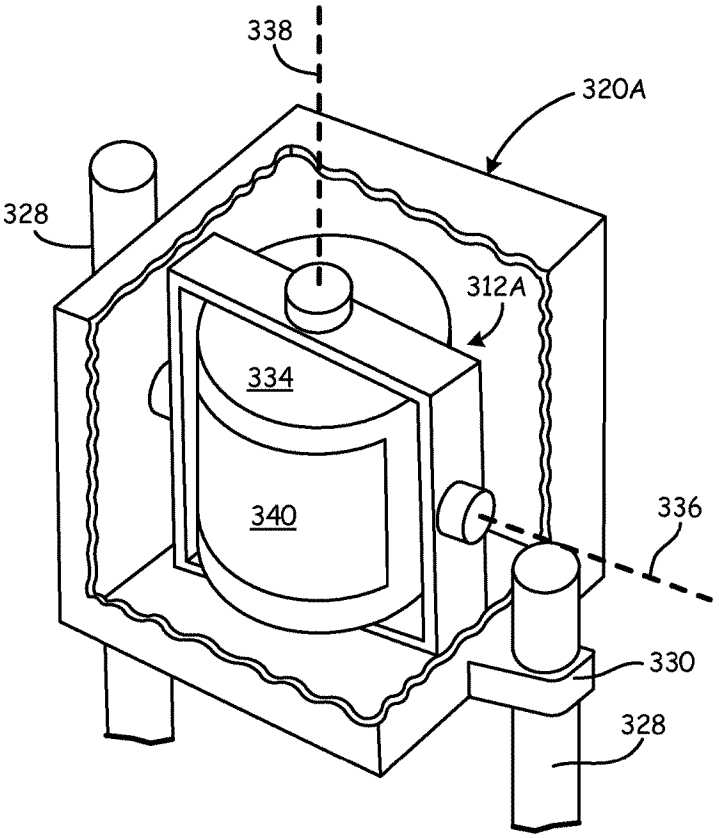
FIG. 8C is a partial cutaway view of the workpiece fixture shown in FIG. 8B.
Figure 8B:
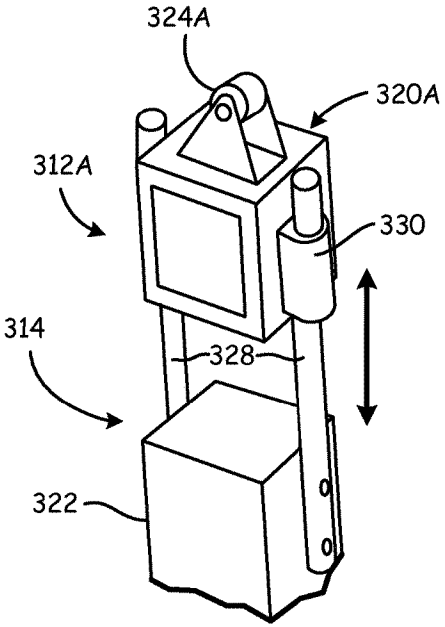
FIG. 8B is a detailed view of a configuration for incorporating the workpiece fixture into an arm assembly having a noncircular path.

FIG. 8B is an example in which fixture 312A is incorporated into telescoping sleeve 320A. Here, fixture 312A and sleeve 320A are supported at an outboard position by rails 328 and bearings 330 secured to central arm 322. Cam follower 324A is disposed at one distal end of arm assembly 314 and runs along track 326 (shown in FIG. 8A).

FIG. 8C is a cutaway and magnified view of a portion of FIG. 8B, and shows fixture 312A and sleeve 320A with workpiece housing 334 disposed therein. Like other embodiments, workpiece housing 334 is rotatable around one or more secondary axes (here axes 336 and 338). Housing 334 includes a receptacle for receiving and retaining at least one workpiece which can be accessed, for example, through door 340.

Figure 9:
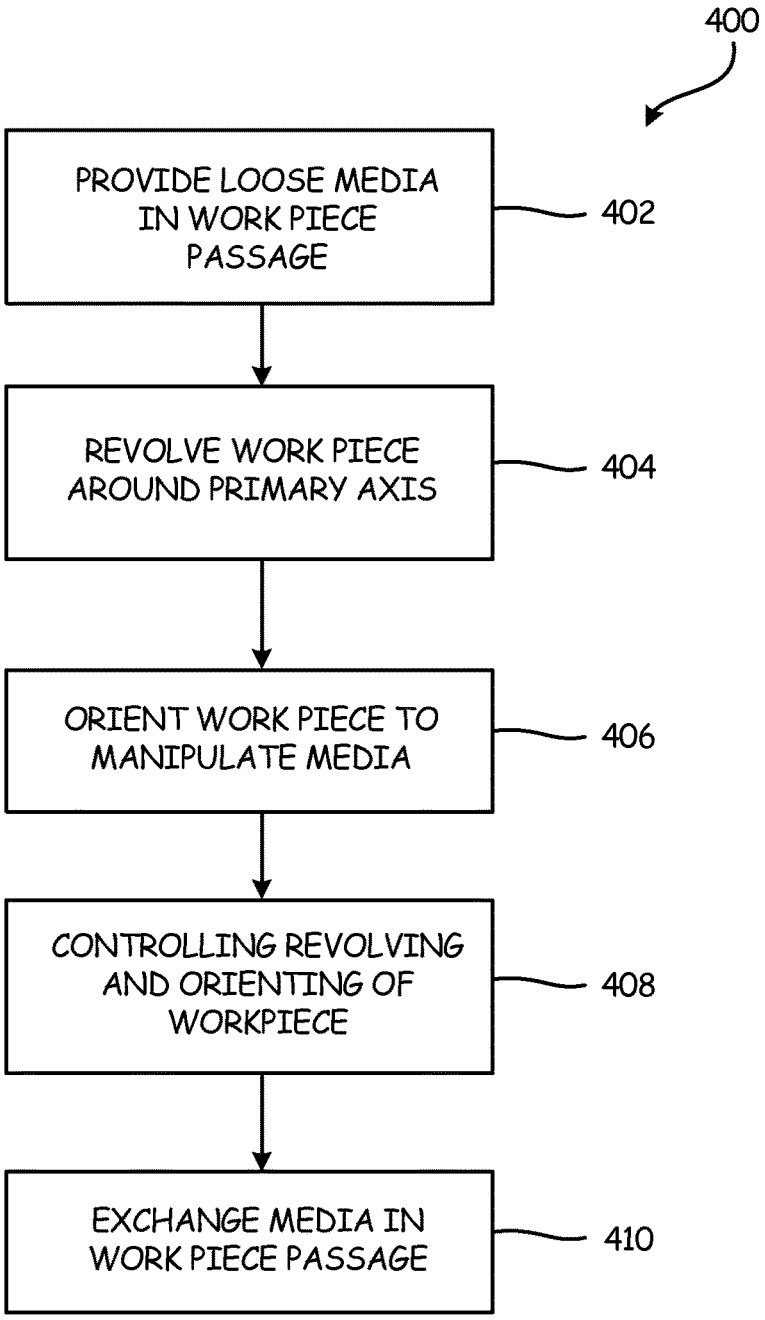
FIG. 9 is a flowchart illustrating the steps of a method for processing a hollow workpiece.

FIG. 9 shows steps of method 400 for processing internal surfaces of a workpiece. Method 400 for processing a workpiece includes step 402, whereby loose processing media is provided within an internal passage of a workpiece. As noted above, the media can be retained in the passage(s) by caps, passage extensions, or other suitable structures. The retention structures can be reusable or sacrificial, and built along with the workpiece.

Processing media can include, among other things, a transport agent and/or an abrasive agent. The transport agent can include a solid, a fluid, or a fluidized agent. Examples of suitable transport fluids include pressurized gas (air or inert gas), water, and mineral oil. The solid can be a metal, ceramic, or polymer. Abrasive media can be selected from a group including but not limited to alumina, silicon carbide (SiC), silica, carbon, metal, organic material, and combinations thereof.

With the media in place, step 404 can include revolving the workpiece around a primary axis so as to accelerate the processing media against one or more targeted internal surfaces defining the internal passage. This provides an enhanced gravity field to the workpiece (and processing media) as noted above. This step can take place via centrifuge with a circular or noncircular path, as well as a planar or nonplanar path. Rotation can be continuous or intermittent, with constant or variable rotational velocity during iteration(s) of step 404.

As part of step 406, the workpiece can be oriented to manipulate the loose processing media relative to the one or more targeted internal surfaces. For example, the workpiece can be mounted to or secured within an enclosure or other suitable fixture/housing and rotated about one or more secondary axes. The fixture/housing can also be adapted to impart reciprocating, oscillating, or other non-rotational motion to the workpiece and/or loose finishing media. The fixture can be disposed at an outboard location and rotatable about one or more secondary axes to reposition and manipulate the processing media located therein. When step 406 is done in conjunction with one or more iterations of revolving step 404 (either simultaneously or alternately), internal targeted surfaces can be processed according to step 408.

As part of step 408, controlling the revolving step and the orienting step to process the one or more targeted surfaces, a processing control module or other device can provide commands to the various motors and valves to provide a targeted surface with a desired finish. In scenarios which have a high risk of fatigue, a suitable surface roughness can be provided down to about Ra 16 microinches or less in some instances.

Optionally, step 410 includes iteratively repeating one or more of the above steps. For example, it may be that progressively finer grit may be needed to achieve the desired result. Additionally or alternatively, different internal surfaces (in the same or different passage) could require different parameters. As such, the processing media can be periodically moved and/or exchanged manually or automatically.

This apparatus and method are anticipated to be useful in a variety of manufacturing scenarios. One expected area of use is in conjunction with additive-manufactured high temperature materials such as those in turbine engine applications. A relatively rough surface finish with an attendant fatigue life reduction is an inherent feature of current additive manufacturing processes. Enabling directed, aggressive abrasive media action on both external and internal work piece passage surfaces such as walls, struts, ribs, fillets, and cavities will significantly open the turbine engine design space for components fabricated with additive manufacturing. The low cost of the apparatus combined with the accelerated abrasion rate this process offers means that rapid, low cost part finishing may be realized.

Discussion of Possible Embodiments

The following are non-exclusive descriptions of possible embodiments of the present invention.

An embodiment of an apparatus includes a centrifugal drive unit, an arm assembly operatively connected to the centrifugal drive unit and configured to revolve about a primary axis perpendicular to the arm, and a workpiece fixture. The workpiece fixture is mounted to the arm assembly, and is configured to rotate at least one workpiece about at least one axis outboard of the primary axis.

The apparatus of the preceding paragraph can optionally include, additionally and/or alternatively, any one or more of the following features, configurations and/or additional components:

An apparatus according to an exemplary embodiment of this disclosure, among other possible things includes a centrifugal drive unit; an arm assembly operatively connected to the centrifugal drive unit and configured to revolve about a primary axis perpendicular to the arm; and a workpiece fixture mounted to a distal end of the arm assembly, the workpiece fixture includes at least one receptacle for receiving and retaining a workpiece and processing media, and is configured to rotate at least one workpiece about at least one secondary axis outboard of the primary axis.

A further embodiment of the foregoing apparatus, wherein the arm assembly is configured to revolve the workpiece fixture along a circular path about the primary axis.

A further embodiment of any of the foregoing apparatus, wherein the arm assembly has an adjustable length such that the arm assembly is configured to revolve the workpiece fixture along a noncircular path about the primary axis.

A further embodiment of any of the foregoing apparatus, wherein the apparatus further comprises at least one actuator connected to the arm assembly and configured to enable out-of-plane rotation of the arm assembly and the workpiece fixture.

A further embodiment of any of the foregoing apparatus, wherein the apparatus further comprises a dynamic balancing ring disposed at a junction of the centrifugal drive unit and the arm assembly.

A further embodiment of any of the foregoing apparatus, wherein the workpiece fixture comprises an open gimbaled fixture.

A further embodiment of any of the foregoing apparatus, wherein the workpiece fixture comprises an elongated tumbling fixture.

A further embodiment of any of the foregoing apparatus, wherein the tumbling fixture includes a wedge valve.

A further embodiment of any of the foregoing apparatus, wherein the workpiece fixture comprises a gimbaled housing with at least one enclosure.

A further embodiment of any of the foregoing apparatus, wherein the apparatus further comprises a transport conduit disposed along the arm assembly, and connecting a media reservoir and the workpiece fixture.

A further embodiment of any of the foregoing apparatus, wherein the arm assembly includes at least one telescoping portion disposed between the workpiece fixture and the primary axis.

A further embodiment of any of the foregoing apparatus, wherein the arm assembly includes at least one cam follower in communication with a track disposed on or about the centrifugal drive unit.

An embodiment of a method for processing a workpiece having at least one internal passage includes providing processing media within the internal passage of the workpiece. The workpiece is revolved around an external axis so as to accelerate the processing media against one or more targeted internal surfaces defining the internal passage. The workpiece is oriented to manipulate the processing media relative to the one or more targeted surfaces. The revolving step and the orienting step are controlled to uniformly process the one or more targeted surfaces.

The method of the preceding paragraph can optionally include, additionally and/or alternatively, any one or more of the following features, configurations and/or additional components:

A method according to an exemplary embodiment of this disclosure, among other possible things includes providing loose processing media within the internal passage of the workpiece; revolving the workpiece around an external axis so as to accelerate the processing media against one or more targeted internal surfaces defining the internal passage; orienting the workpiece to manipulate the loose processing media relative to the one or more targeted surfaces; and controlling the revolving step and the orienting step to uniformly process the one or more targeted surfaces.

A further embodiment of the foregoing method, wherein the media comprises at least one of a transport agent and an abrasive agent.

A further embodiment of any of the foregoing methods, wherein the orienting step comprises continuously rotating the workpiece about at least one internal axis.

A further embodiment of any of the foregoing methods, wherein the orienting step comprises intermittently rotating the workpiece about at least one internal axis.

A further embodiment of any of the foregoing methods, wherein the method further comprises: exchanging at least a portion of the processing media in the workpiece; and repeating the revolving, orienting, and controlling steps.

A further embodiment of any of the foregoing methods, wherein the revolving step comprises: securing the workpiece to a centrifuge defining the external axis; operating the centrifuge to move the workpiece around the external axis; and dynamically balancing the centrifuge and the workpiece.

A further embodiment of any of the foregoing methods, wherein the method further comprises oscillating the workpiece during the revolving step.

A further embodiment of any of the foregoing methods, wherein the method further comprises modifying a path of the workpiece around the primary axis during the revolving step, wherein the modifying step comprises changing a distance of the workpiece relative to the second axis.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An apparatus comprising:

a centrifugal drive unit;

an arm assembly operatively connected to the centrifugal drive unit and configured to revolve about a primary axis perpendicular to the arm; and a workpiece fixture mounted to the arm assembly, the workpiece fixture includes at least one receptacle for receiving and retaining a workpiece and processing media, and is configured to rotate at least one workpiece about at least one secondary axis outboard of the primary axis;

wherein the arm assembly has an adjustable length such that the arm assembly is configured to revolve the workpiece fixture along a noncircular path about the primary axis; and wherein the workpiece fixture comprises an open gimbaled fixture or a gimbaled housing with at least one enclosure.

2. The apparatus of claim 1, further comprising at least one actuator connected to the arm assembly and configured to enable out-of-plane rotation of the arm assembly and the workpiece fixture.

3. The apparatus of claim 1, further comprising:

a dynamic balancing ring disposed at a junction of the centrifugal drive unit and the arm assembly.

4. The apparatus of claim 1, wherein the workpiece fixture comprises an elongated tumbling fixture.

5. The apparatus of claim 4, wherein the tumbling fixture includes a wedge valve.

6. The apparatus of claim 1, further comprising:

a transport conduit disposed along the arm assembly, and connecting a media reservoir and the workpiece fixture.

7. The apparatus of claim 1, wherein the arm assembly includes at least one telescoping portion disposed between the workpiece fixture and the primary axis.

8. The apparatus of claim 7, wherein the arm assembly includes at least one cam follower in communication with a track disposed on or about the centrifugal drive unit.

9. A method for processing a workpiece having at least one internal passage, the method comprising:

providing an open gimbaled fixture or a gimbaled housing with at least one enclosure;

providing loose processing media within the internal passage of the workpiece;

revolving the workpiece around an external axis so as to accelerate the processing media against one or more targeted internal surfaces defining the internal passage;

oscillating the workpiece during the revolving step;

orienting the workpiece to manipulate the loose processing media relative to the one or more targeted surfaces; and controlling the revolving step and the orienting step to uniformly process the one or more targeted surfaces;

wherein the orienting step comprises:

rotating the workpiece about at least one internal axis outboard of the external axis via the open gimbaled fixture, or the gimbaled housing with at least one enclosure.

10. The method of claim 9, wherein the media comprises at least one of a transport agent and an abrasive agent.

11. The method of claim 9, wherein the orienting step comprises:

continuously rotating the workpiece about the at least one internal axis.

12. The method of claim 9, wherein the orienting step comprises:

intermittently rotating the workpiece about the at least one internal axis.

13. The method of claim 9, further comprising:

exchanging at least a portion of the processing media in the workpiece; and repeating the revolving, orienting, and controlling steps.

14. The method of claim 9, wherein the revolving step comprises:

securing the workpiece to a centrifuge defining the external axis;

operating the centrifuge to move the workpiece around the external axis; and dynamically balancing the centrifuge and the workpiece.

15. The method of claim 9, further comprising:

modifying a path of the workpiece around the primary axis during the revolving step, wherein the modifying step comprises:

changing a distance of the workpiece relative to at least one internal axis.

16. An apparatus comprising:

a centrifugal drive unit;

an arm assembly operatively connected to the centrifugal drive unit and configured to revolve about a primary axis perpendicular to the arm;

a workpiece fixture mounted to the arm assembly, the workpiece fixture includes at least one receptacle for receiving and retaining a workpiece and processing media, and is configured to rotate at least one workpiece about at least one secondary axis outboard of the primary axis; and at least one actuator connected to the arm assembly and configured to enable out-of-plane rotation of the arm assembly and the workpiece fixture.

17. The apparatus of claim 16, wherein the arm assembly is configured to revolve the workpiece fixture along a circular path about the primary axis.

18. The apparatus of claim 16, wherein the arm assembly has an adjustable length such that the arm assembly is configured to revolve the workpiece fixture along a noncircular path about the primary axis.

19. The apparatus of claim 16, further comprising:

a dynamic balancing ring disposed at a junction of the centrifugal drive unit and the arm assembly.

20. The apparatus of claim 16, wherein the workpiece fixture comprises an open gimbaled fixture.

21. The apparatus of claim 16, wherein the workpiece fixture comprises an elongated tumbling fixture.

22. The apparatus of claim 21, wherein the tumbling fixture includes a wedge valve.

23. The apparatus of claim 16, wherein the workpiece fixture comprises a gimbaled housing with at least one enclosure.

24. The apparatus of claim 16, further comprising:

a transport conduit disposed along the arm assembly, and connecting a media reservoir and the workpiece fixture.

25. The apparatus of claim 16, wherein the arm assembly includes at least one telescoping portion disposed between the workpiece fixture and the primary axis.

26. The apparatus of claim 25, wherein the arm assembly includes at least one cam follower in communication with a track disposed on or about the centrifugal drive unit.

27. An apparatus comprising:

a centrifugal drive unit;

an arm assembly operatively connected to the centrifugal drive unit and configured to revolve about a primary axis perpendicular to the arm; and a workpiece fixture mounted to the arm assembly, the workpiece fixture includes at least one receptacle for receiving and retaining a workpiece and processing media, and is configured to rotate at least one workpiece about at least one secondary axis outboard of the primary axis;

wherein the arm assembly includes at least one telescoping portion disposed between the workpiece fixture and the primary axis; and wherein the workpiece fixture comprises an open gimbaled fixture or a gimbaled housing with at least one enclosure.

28. The apparatus of claim 27, wherein the arm assembly is configured to revolve the workpiece fixture along a circular path about the primary axis.

29. The apparatus of claim 27, wherein the arm assembly has an adjustable length such that the arm assembly is configured to revolve the workpiece fixture along a noncircular path about the primary axis.

30. The apparatus of claim 27, further comprising at least one actuator connected to the arm assembly and configured to enable out-of-plane rotation of the arm assembly and the workpiece fixture.

31. The apparatus of claim 27, further comprising:

a dynamic balancing ring disposed at a junction of the centrifugal drive unit and the arm assembly.

32. The apparatus of claim 27, wherein the workpiece fixture comprises an elongated tumbling fixture.

33. The apparatus of claim 32, wherein the tumbling fixture includes a wedge valve.

34. The apparatus of claim 27, further comprising:

a transport conduit disposed along the arm assembly, and connecting a media reservoir and the workpiece fixture.

35. The apparatus of claim 27, wherein the arm assembly includes at least one cam follower in communication with a track disposed on or about the centrifugal drive unit.

36. A method for processing a workpiece having at least one internal passage, the method comprising:

providing an open gimbaled fixture or a gimbaled housing with at least one enclosure;

providing loose processing media within the internal passage of the workpiece;

revolving the workpiece around an external axis so as to accelerate the processing media against one or more targeted internal surfaces defining the internal passage;

orienting the workpiece to manipulate the loose processing media relative to the one or more targeted surfaces, wherein the orienting step comprises:

rotating the workpiece about at least one internal axis outboard of the external axis via the open gimbaled fixture, or the gimbaled housing with at least one enclosure;

controlling the revolving step and the orienting step to uniformly process the one or more targeted surfaces; and modifying a path of the workpiece around the external axis during the revolving step, wherein the modifying step comprises:

changing a distance of the workpiece relative to the external axis.

37. The method of claim 36, wherein the media comprises at least one of a transport agent and an abrasive agent.

38. The method of claim 36, wherein the orienting step comprises:

continuously rotating the workpiece about the at least one internal axis.

39. The method of claim 36, wherein the orienting step comprises:

intermittently rotating the workpiece about the at least one internal axis.

40. The method of claim 36, further comprising:

exchanging at least a portion of the processing media in the workpiece; and repeating the revolving, orienting, and controlling steps.

41. The method of claim 36, wherein the revolving step comprises:

securing the workpiece to a centrifuge defining the external axis;

operating the centrifuge to move the workpiece around the external axis; and dynamically balancing the centrifuge and the workpiece.

42. The method of claim 36, further comprising:

oscillating the workpiece during the revolving step.

* * * * *